US006719337B1

(12) United States Patent
Ji

(10) Patent No.: US 6,719,337 B1
(45) Date of Patent: Apr. 13, 2004

(54) PUSH-PUSH LATCH

(75) Inventor: Lianli Ji, West Chester, PA (US)

(73) Assignee: Southco, Inc., Concordville, PA (US)

( * ) Notice: Subject to any disclaimer, the term of this patent is extended or adjusted under 35 U.S.C. 154(b) by 92 days.

(21) Appl. No.: 09/705,669

(22) Filed: Nov. 3, 2000

(51) Int. Cl.[7] ..... E05B 15/02

(52) U.S. Cl. ..... 292/341.17; 292/110; 292/121; 292/122; 292/150; 292/DIG. 4

(58) Field of Search ..... 292/341.17, 110, 292/121, 122, DIG. 4, 78, DIG. 49, 150, 114

(56) References Cited

U.S. PATENT DOCUMENTS

| | | | | | |
|---|---|---|---|---|---|
| 462,183 | A | | 10/1891 | Varney | |
| 477,654 | A | | 6/1892 | Grimes | |
| 619,772 | A | | 2/1899 | Martin | |
| 682,242 | A | | 9/1901 | Curley | |
| 850,840 | A | | 4/1907 | Ledford | |
| 1,039,953 | A | | 10/1912 | Kalivoda | |
| 1,069,079 | A | | 7/1913 | Voight | |
| 1,853,564 | A | | 4/1932 | Jacobi | |
| 2,294,683 | A | * | 9/1942 | Murphy | 292/99 |
| 2,496,737 | A | | 2/1950 | McCallick et al. | 292/1 |
| 2,536,295 | A | | 1/1951 | Leonard, Sr. | 292/1 |
| 3,111,833 | A | | 11/1963 | Dettmer | 70/140 |
| 3,122,012 | A | | 2/1964 | Christopher | 70/140 |
| 3,222,899 | A | | 12/1965 | Bodoh et al. | 70/140 |
| 3,234,765 | A | | 2/1966 | Kerr | 70/208 |
| 3,438,227 | A | | 4/1969 | Wolniak | 70/208 |
| 3,605,200 | A | | 9/1971 | Vallinotto et al. | 24/20 TT |
| 3,638,457 | A | * | 2/1972 | Filipak | 68/12 R |
| 3,659,444 | A | | 5/1972 | Wellekens | 70/360 |
| 3,841,674 | A | | 10/1974 | Bisbing et al. | 292/175 |
| 3,850,464 | A | | 11/1974 | Bisbing et al. | 292/175 |
| 3,905,626 | A | * | 9/1975 | Myers | 292/216 |
| 4,132,092 | A | | 1/1979 | Steinbach | 70/208 |
| 4,383,707 | A | * | 5/1983 | Nishimura | 292/110 |
| 4,552,001 | A | | 11/1985 | Roop | 70/208 |
| 4,655,489 | A | | 4/1987 | Bisbing | 292/110 |
| 4,660,871 | A | * | 4/1987 | Arakawa et al. | 292/81 |
| 4,687,237 | A | * | 8/1987 | Bisbing | 292/78 |
| 4,688,834 | A | * | 8/1987 | Nakayama | 292/5 |
| 4,689,976 | A | | 9/1987 | Larsen | 70/208 |
| 4,709,949 | A | * | 12/1987 | Umezawa et al. | 292/6 |
| 4,779,906 | A | * | 10/1988 | Kurosaki | 292/19 |
| D312,769 | S | | 12/1990 | Bisbing | D8/338 |
| 4,978,152 | A | | 12/1990 | Bisbing | 292/169 |
| 5,180,201 | A | | 1/1993 | Hauber | 292/336.3 |
| 5,292,158 | A | * | 3/1994 | Kurosaki | 292/45 |
| 5,346,266 | A | | 9/1994 | Bisbing | 292/64 |
| 5,467,619 | A | | 11/1995 | Stillwagon et al. | 70/34 |
| 5,775,748 | A | * | 7/1998 | Kurachi | 292/341.15 |
| 5,997,056 | A | * | 12/1999 | Yamagishi | 292/341.17 |
| 6,109,667 | A | * | 8/2000 | Collins | 292/78 |
| 6,203,077 | B1 | * | 3/2001 | Schlack | 292/203 |
| 6,250,694 | B1 | * | 6/2001 | Weiland | 292/110 |

OTHER PUBLICATIONS

Hafele Caravan Beschlage Katalog (pp. 8–10).
Lamp® Sugatsune America, Inc. Catalog pp. 82, 85, et al.;.
Southco® Handbook 2000 (pp. 130–131).

* cited by examiner

*Primary Examiner*—Robert J. Sandy
*Assistant Examiner*—Carlos Lugo
(74) *Attorney, Agent, or Firm*—Paul & Paul

(57) ABSTRACT

A latch wherein latching and unlatching is accomplished by an inward push by the keeper into the latch housing. The latch uses an improved housing configuration in conjunction with improved internal components, allowing for more consistent and reliable operation.

37 Claims, 7 Drawing Sheets

PUSH-PUSH LATCH

BACKGROUND OF THE INVENTION

1. Field of the Invention

The invention is a latch wherein latching and unlatching are accomplished by an inward push of a keeper into the latch housing.

2. Description of the Related Art

Although push-push latches have been proposed in the art, none are seen to provide the positive and reliable operation of the push-push latch of the present invention.

An example of a known push-push latch is described in U.S. Pat. No. 4,655,489 issued to Robert Bisbing on Apr. 7, 1987. The push-push latch of Bisbing uses a spring having a portion under compression and a portion in tension. The Bisbing latch is difficult to assemble and requires one side of the latch housing to be removable for assembly. The simplified design of the present invention allows the use of a one piece housing which reduces manufacturing cost.

SUMMARY OF THE INVENTION

The present invention is a latch wherein latching and unlatching are controlled by an inward push by the keeper towards the latch, generally known as a push-push latch.

The latch includes a housing, containing a hook beam, a shuttle opposite the hook beam, and a compression spring, for biasing the shuttle upward within the housing. The latch mates with a corresponding keeper to secure a moving member, such as a door or drawer, to a nonmoving member, such as the frame of the door or drawer. The latch will typically be secured to the nonmoving member, with the keeper secured to the moving member, but the opposite arrangement will work equally well. It should be noted that the following summary refers to a top, bottom, left, right, etc. for simplicity of reference only, and not to imply that the orientation of the latch is critical to its function.

The housing is generally rectangular, and is preferably made of one-piece construction. The housing is in the form of a shell defining a cavity having an interior, and an opening in its top surface. The housing has a pair of opposing openings in its front and back surfaces. A pair of opposing snap legs extends downward and inward into the housing from the top edges of the opposing openings. A second pair of opposing snap legs extends upward and outward from the bottom of the housing's left and right sides, ending with a ridged surface. The front of the housing further has an additional opening on the same side of the housing as the hook beam. A resilient finger extends from the bottom edge of the opening upward and slightly inward. The bottom of the housing also has a ramp located at the bottom rear corner of the interior below the shuttle of the latch and to one side of the spring. The ramp forms an inclined plane which slants upward in back of the spring and shuttle of the latch.

The hook beam is located within the housing, extending from the top opening towards the bottom of the housing. The hook beam includes a top hook for engaging the keeper, described below. The hook includes a flange extending to one side. A small detent boss projects from the side of the hook opposite the flange. The hook beam also includes a stem. The stem includes a central projection which extends outward towards the shuttle and which preferably has a flat top side. The bottom end of the hook beam further includes a pivot, which is preferably a pair of bosses projecting from either side of the bottom end of the hook beam. The pivot bosses of the hook beam are positioned between the inner snap legs and the bottom of the front and back openings. The motion of the bottom end of the hook beam is rather complex. The pivot bosses are constrained within the front and rear openings in the housing. The front and rear openings are elongated and allow the bottom end of the hook beam to translate to the left or right, as well as for the hook beam to pivot about the central axis of the bosses. The left end of the front and rear openings is notched which additionally allows the pivot end of the beam to move up and down when the pivot bosses are positioned at the left end of the front and rear openings. The bottom end of the hook beam also includes a projection, which projects approximately perpendicularly to the left of the hook beam. The projection preferably has a hook shape.

The shuttle is located opposite the top hook. The bottom portion of the shuttle defines a channel for guiding the compression spring, which abuts the bottom of the housing. The top of the shuttle includes a top surface for making contact with the keeper (described later). The top of the shuttle further includes an overhang for making contact with the top side of the central projection of the hook beam. An arm extends outward from one side of the top of the shuttle in the same direction as the overhang, immediately below the flange extending from the hook beam's hook. A skirt extends downward and to the right from the top portion of the shuttle, being dimensioned and configured to push against the perpendicular projection at the bottom of the hook beam, when the hook beam is in the unlatched configuration.

The keeper includes a mounting plate, preferably having an adhesive backing, and a hook. The keeper's hook is dimensioned and configured to push downward on the shuttle's top portion, and to engage the hook beam's top hook.

The latch will typically be installed within a socket. The socket is shaped to correspond with the shape of the housing, to prevent misalignment of the latch. Upon inserting the latch into the socket, the ridges on the outer snap legs will engage the edges of the socket, securing the latch within the socket. The keeper is then inserted into the latch, where it is secured therein as described below. The adhesive backing of the keeper is exposed, and the moving member to be secured by the latch is brought into its closed position, in contact with the adhesive. When the adhesive is dry, the keeper will be secured in the proper position to engage the latch.

The latching and unlatching cycle begins with the hook beam in its upward vertical position, against one side of the housing opposite the shuttle. To actuate the latch, the moving member is moved into its closed position, thereby bringing the keeper and latch together, and inserting the keeper's hook into the latch. The keeper pushes the shuttle toward the bottom of the housing, causing the shuttle's skirt to push against the hook beam's bottom arm, rotating the hook beam's top hook into engagement with the keeper's hook. As the hook beam's top hook rotates, the detent boss near the hooked end of the beam is snapped onto the left side of the resilient finger of the housing thereby ensuring the proper position of the hook beam's top hook for engagement with the keeper's hook. At this point, the user will release pressure on the moving member, allowing the spring to push the shuttle upward, thereby pushing the keeper slightly upward. As the keeper pulls on the top hook of the hook beam, the hook beam is pulled into a vertical position. Proper vertical alignment of the hook beam is insured by the detent boss near the hooked end of the beam, which is constrained from moving back to its original position by the resilient finger of the housing. Continued upward motion of the shuttle is prevented by the keeper hook, which is held by the hooked end of the hook beam and blocks the shuttle from returning to its original position. The latch is now securely latched.

To unlatch the latch, the moving member is again pushed inward, thereby causing the keeper to push the shuttle inward. The overhang of the top portion of the shuttle pushes down on the hook beam's central projection, causing the hook beam to move down. As the hook beam moves down, the perpendicular projection or arm at the bottom of the hook beam contacts the ramp of the housing which creates a reaction force which rotates the top hook and stem of the hook beam away from the hook of the keeper which allows the keeper's hook to exit the latch. As the top hook is rotated away from the hook of the keeper, the detent boss at the top of the stem of the hook beam is snapped into the right side of the resilient finger of the housing. As pressure is released on the keeper, the shuttle moves fully forward. The shuttle's flange pushes on the side flange of the hook beam's top hook, thereby moving the hook beam back into its original position. Proper vertical alignment of the hook is ensured by the detent boss on the hook beam, which is constrained from moving back to its previous position by the resilient finger of the housing.

It is therefore an object of the present invention to provide a latch wherein latching and unlatching is accomplished by an inward push by the keeper on the latch.

It is another object of the invention to provide a latch where proper alignment of the hook beam of the latch is insured during the latching and unlatching of the latch.

These and other objects of the invention will become apparent through the following description and claims.

BRIEF DESCRIPTION OF THE DRAWINGS

Like reference numbers denote like elements throughout the drawings.

DETAILED DESCRIPTION OF THE PREFERRED EMBODIMENTS

Figure 1:
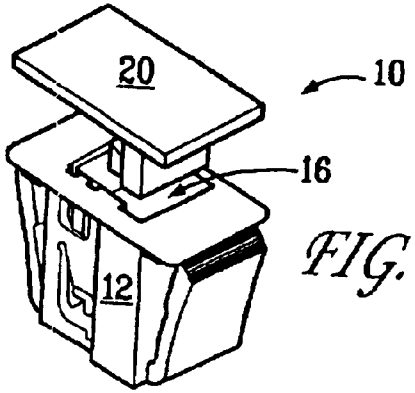
FIG. 1 is a perspective view of a latch assembly according to the present invention.
Figure 2:
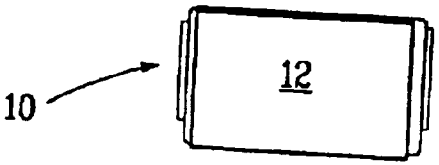
FIG. 2 is a top view of a latch assembly and keeper according to the present invention.
Figure 3:
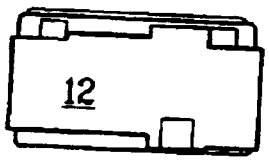
FIG. 3 is a bottom view of a latch assembly and keeper according to the present invention.
Figure 4:
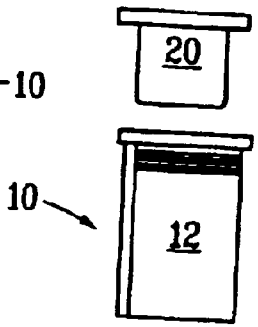
FIG. 4 is a right side view of a latch assembly and keeper according to the present invention.
Figure 5:
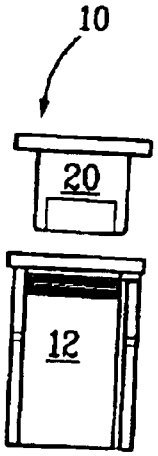
FIG. 5 is a left side view of a latch assembly and keeper according to the present invention.
Figure 6:
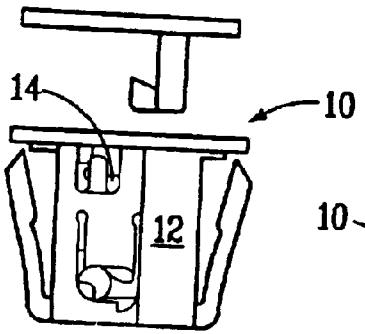
FIG. 6 is a front view of a latch assembly and keeper according to the present invention.
Figure 7:
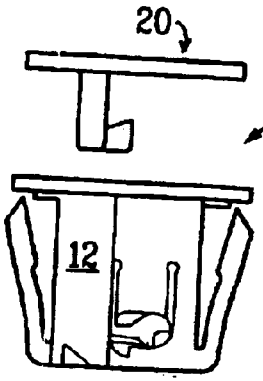
FIG. 7 is a back view of a latch assembly and keeper according to the present invention.
Figure 8:
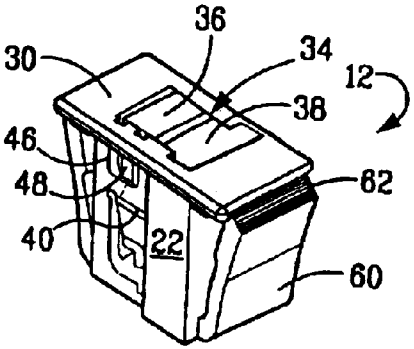
FIG. 8 is a perspective view a latch assembly according to the present invention.
Figure 14:
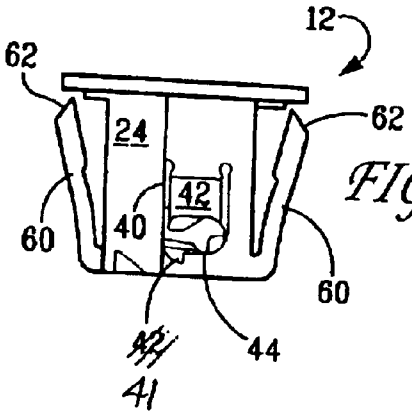
FIG. 14 is a back view of a latch assembly according to the present invention.
Figure 9:
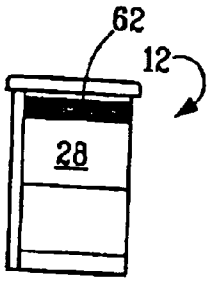
FIG. 9 is a left side view of a latch assembly according to the present invention.
Figure 11:
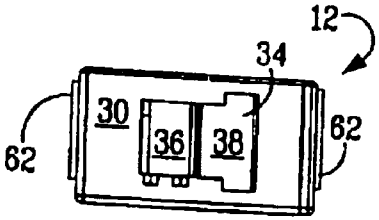
FIG. 11 is a top view of a latch assembly according to the present invention.
Figure 13:
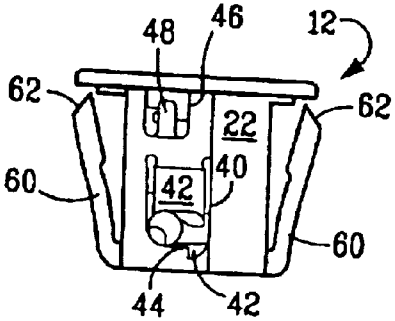
FIG. 13 is a front view of a latch assembly according to the present invention.
Figure 12:
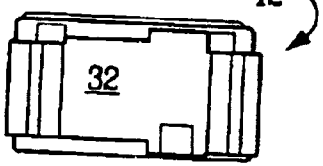
FIG. 12 is a bottom view of a latch assembly according to the present invention.
Figure 10:
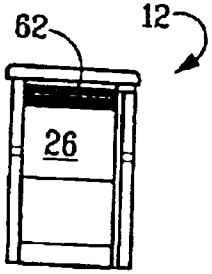
FIG. 10 is a right side view of a latch assembly according to the present invention.
Figure 15:
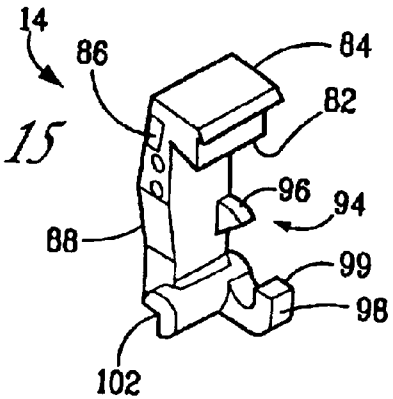
FIG. 15 is a perspective view of the hook beam for a latch assembly according to the present invention.
Figure 16:
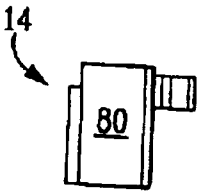
FIG. 16 is a top view of the hook beam for a latch assembly according to the present invention.
Figure 21:
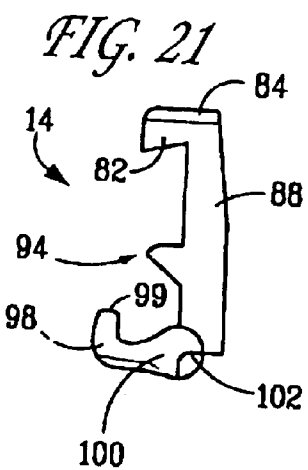
FIG. 21 is a back view of the hook beam for a latch assembly according to the present invention.
Figure 19:
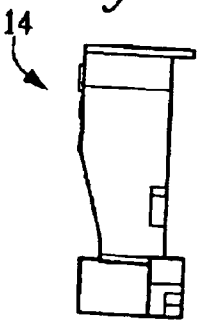
FIG. 19 is a left side view of the hook beam for a latch assembly according to the present invention.
Figure 20:
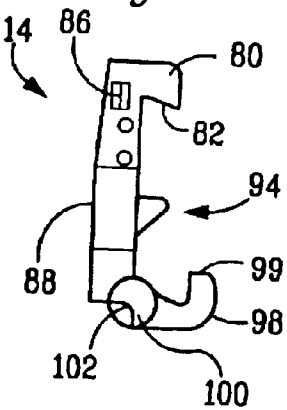
FIG. 20 is a front view of the hook beam for a latch assembly according to the present invention.
Figure 17:
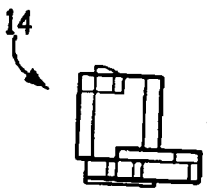
FIG. 17 is a bottom view of the hook beam for a latch assembly according to the present invention.
Figure 18:
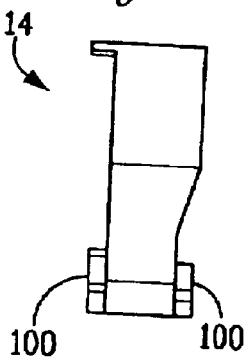
FIG. 18 is a right side view of the hook beam for a latch assembly according to the present invention.
Figure 22:
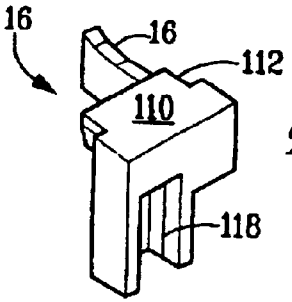
FIG. 22 is a perspective view of the shuttle for a latch assembly according to the present invention.
Figure 28:
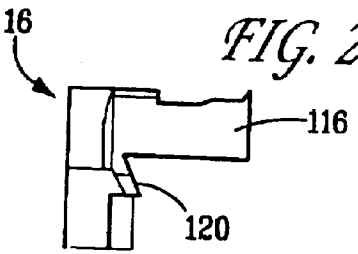
FIG. 28 is a rear view of the shuttle for a latch assembly according to the present invention.
Figure 25:
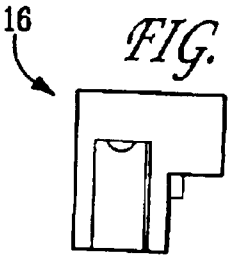
FIG. 25 is a left side view of the shuttle for a latch assembly according to the present invention.
Figure 23:
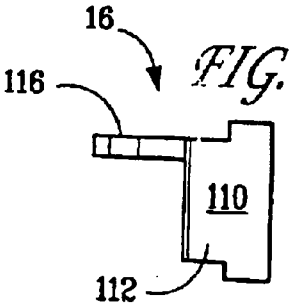
FIG. 23 is a top view of the shuttle for a latch assembly according to the present invention.
Figure 27:
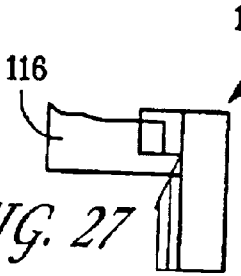
FIG. 27 is a front view of the shuttle for a latch assembly according to the present invention.
Figure 24:
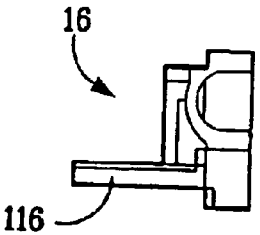
FIG. 24 is a bottom view of the shuttle for a latch assembly according to the present invention.
Figure 26:
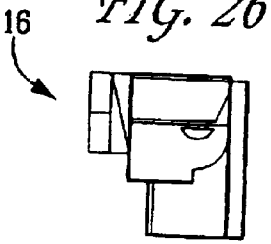
FIG. 26 is a right side view of the shuttle for a latch assembly according to the present invention.

The present invention is a latch wherein latching and unlatching are controlled by an inward push by the keeper towards the bottom of the latch housing, generally known as a push-push latch. Please note that the following description refers to a top, etc. for simplicity of reference only, and not to imply that the orientation of the latch is critical to its function. Referring to FIGS. 1–7 and 40, the latch 10 includes a housing 12, a hook beam 14 within the housing 12, a shuttle 16 opposite the hook beam 14, and a spring 18 biasing the shuttle 16 toward the top opening of the housing 12. The latch mates with a corresponding keeper 20.

Referring to FIGS. 8–11, the housing 12 is illustrated. The housing 12 is of one-piece construction, having a front 22, back 24, a right side 26, a left side 28, a top 30, and a bottom 32. The top 30 defines an opening 34, having a narrow portion 36 corresponding to the right side 26 of the housing 12, and a wide portion 38 corresponding to the left side 28 of the housing 12. The front 22 and back 24 of the housing 12 each define an opening 40. Each opening 40 contains an inner snap leg 42 extending from the top edge of the opening 40 downward and inward. The bottom edges of openings 40 include a notch 42 that forms a corner 44.

The front 22 of the housing 12 further defines an additional opening 46 on the same side as the hook beam 14. A resilient finger 48 extends from the bottom edge of the opening 46 upward and slightly inward. The housing 12 also includes a ramp 52 (FIGS. 32, 34, 36, and 38), which slants upward near the bottom rear corner of the housing 12. The ramp 52 is located to the rear of the spring 18 and below the shuttle 16.

The housing 12 is preferably secured in a socket by a pair of snap legs. The right side 26 and left side 28 each include an outer snap leg 60, extending upward and outward from the bottom 32 of the housing 12. Each outer snap leg 60 has a ridged top end 62.

Referring to FIGS. 15–21, the hook beam 14 is illustrated. The hook beam 14 includes a top hook 80, being dimensioned and configured to mate with the hook of the keeper 20 (described later). The bottom 82 of the top hook 80 is preferably a flat surface. A top flange 84 extends rearward from the top hook 80. The hook beam includes a stem 88 which includes a small roughly prism-shaped detent boss 86 at the top of the stem near the top hook 80. The hook beam 14 further includes a central projection 94 which is roughly trapezoidal in configuration. The top side 96 of the central projection 94 is flat and extends perpendicularly from one side of the stem 88.

The bottom portion of the hook beam 14 includes a bottom arm 98, which in the preferred embodiment has a roughly "L" shape with a flat end 99. The bottom portion of hook beam 14 also includes a pair of opposing bosses 100, being dimensioned and configured to fit within the front and back openings 40 of the housing 12, below the inner snap legs 42. Each boss 100 has a notch or cutout 102 in the form of a circular sector subtended by an angle of less than 180 degrees, being dimensioned and configured to engage the corner 44.

Referring to FIGS. 22–28, the shuttle 16 is illustrated. The shuttle 16 defines a top portion 110 which is "T" shape in top plan view and configured to fit into the wide portion 38 corresponding to the left side 28 of the housing 12 opposite the hook beam 14. The top portion 110 includes an overhang 112 which projects towards the hook beam 14. A flange 116 extends outward from one side of the shuttle 16, being dimensioned and configured to abut the top flange 84 of the hook beam 14. The shuttle 16 is spring-biased forward. The shuttle 16 defines a spring channel 118, dimensioned and configured to contain and guide a compression spring 18. The shuttle 16 also includes a skirt 120 which extends downward and toward the beam 14 from the top portion 112, and dimensioned and configured to engage the bottom projection or arm 98 of the hook beam 14.

Figure 29:
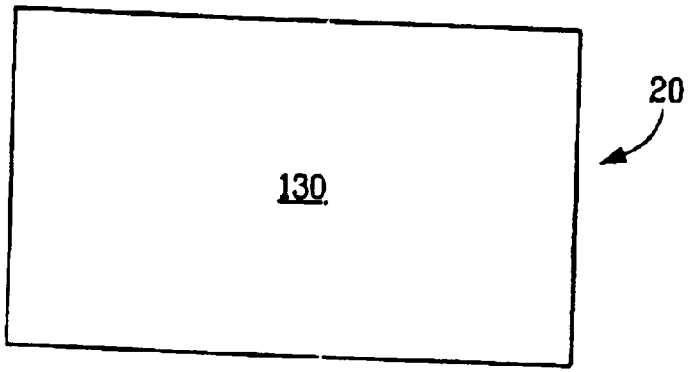
FIG. 29 is a top view of the keeper for a latch assembly according to the present invention.
Figure 30:
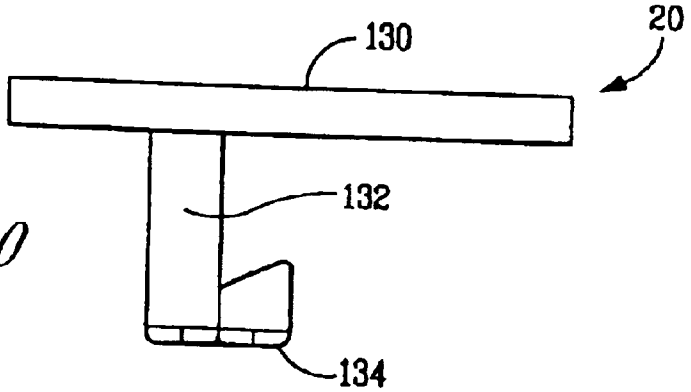
FIG. 30 is a front elevational view of the keeper for a latch assembly according to the present invention.
Figure 31:
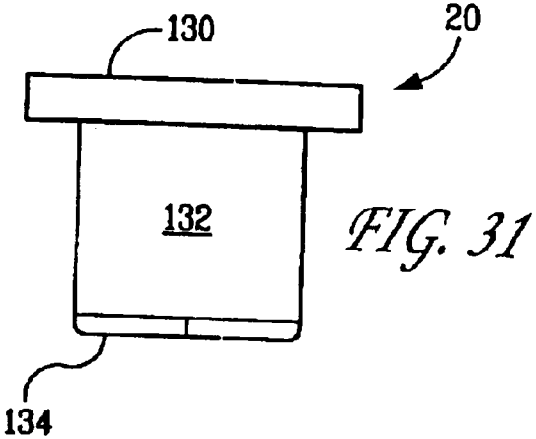
FIG. 31 is a view showing the back of the hook of the keeper for a latch assembly according to the present invention.

Referring to FIGS. 29–31, the keeper 20 is illustrated. The keeper 20 includes a top panel 130 and a hook 132. The hook 132 is dimensioned and configured to pass through the wide portion 38 of the opening 34 of the housing 12 and to be engaged by the hook beam's top hook 80. The hook 132 of the keeper 20 includes a bottom surface 134 for pushing inward on the top portion 110 of the shuttle 16. The back of the top panel 130 preferably includes an adhesive 136 for securing the keeper 20 to one of the two components to be latched together using the latch 10.

The latch 10 and keeper 20 will typically be mounted on opposing moving and nonmoving members, such as a door or drawer and the frame supporting the door or drawer (not shown, and well-known). Typically, the latch 10 will be installed on the nonmoving member, and the keeper 20 will be installed on the moving member, but this may be reversed without affecting the operation of the latch 10. In addition, both members to which the latch 10 and keeper 20 are installed may be movable. The latch 10 will preferably be installed within a socket, with a preferred and suggested socket having the configuration of two intersecting rectangles, corresponding to the shape of the housing 12, to ensure proper alignment. Merely inserting the latch 10 into the socket, with the bottom 32 of the housing 12 first, will cause the ridges 62 of the outer snap legs 60 to engage the edges of the socket, thereby securing the latch 10 within the socket. The keeper 20 is then inserted into the latch 10 for latching (as explained below), and the keeper's adhesive backing 136 is exposed. By bringing the moving member towards the nonmoving member, corresponding to the moving member's closed position, the keeper 20 is secured in the proper position on the opposing member to provide for latching and unlatching.

Figures 32, 33, 34, 35, 36, 37, 38, 39:
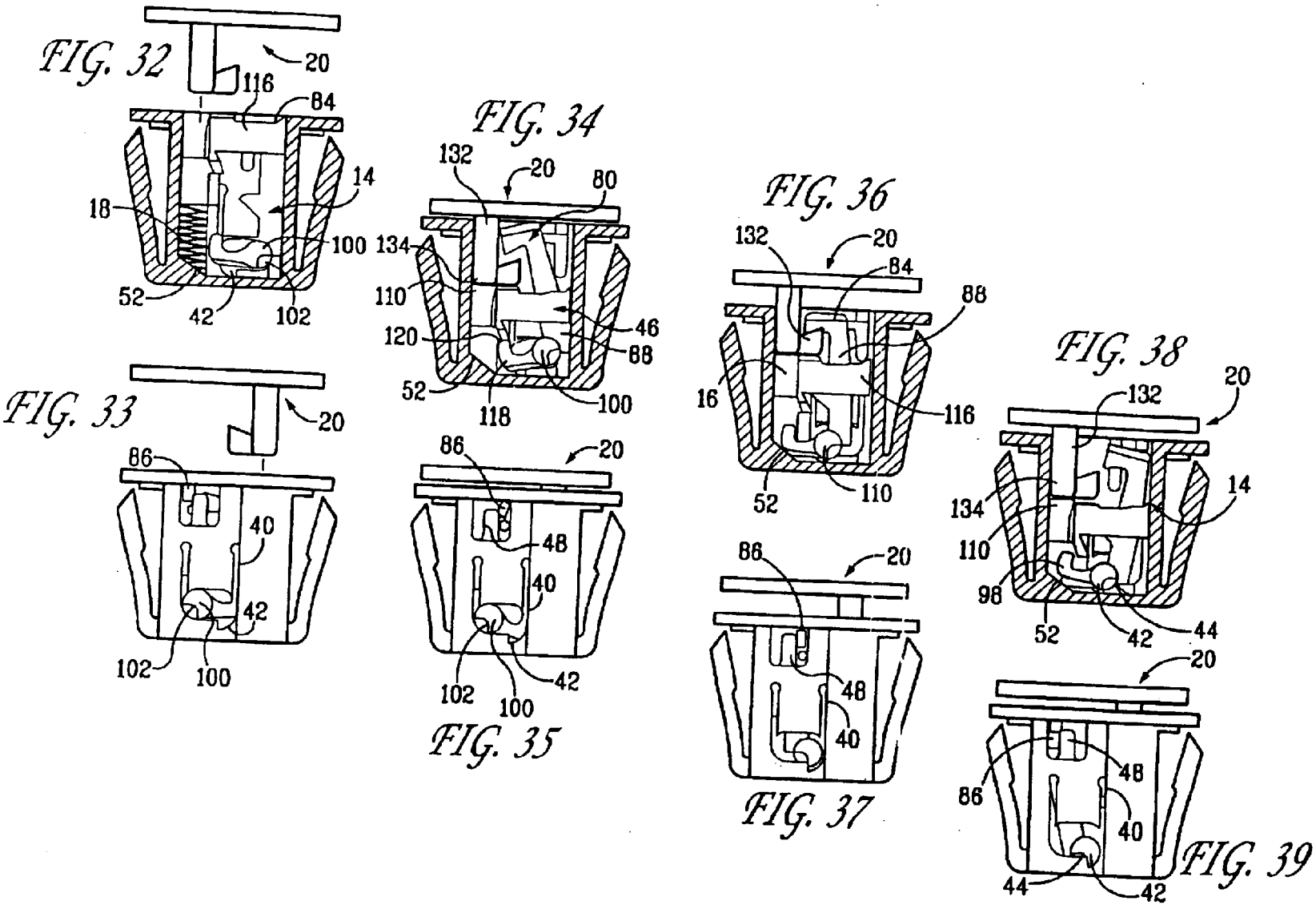
FIG. 32 is a rear view of a latch assembly according to the present invention, with the housing broken away to reveal the positions of the parts at the beginning of the latching cycle.
FIG. 33 is a front view of a latch assembly according to the present invention, showing the position of the parts at the beginning of the latching cycle.
FIG. 34 is a rear view of a latch assembly according to the present invention, with the housing broken away to show the position of the parts at the beginning of the latching cycle.
FIG. 35 is a front view of a latch assembly according to the present invention, showing the position of the parts at the beginning of the latching cycle.
FIG. 36 is a rear view of a latch assembly according to the present invention, with the housing broken away to show the positions of the parts after completion of the first step of the latching cycle.
FIG. 37 is a front view of a latch assembly according to the present invention, showing the position of the parts after completion of the first step of the latching cycle.
FIG. 38 is a rear view of a latch assembly according to the present invention, with the housing broken away to show the positions of the parts after completion of the first step of the unlatching cycle.
FIG. 39 is a front view of a latch assembly according to the present invention, showing the position of the parts after completion of the first step of the unlatching cycle.

The operation of the latch 10 is illustrated sequentially in FIGS. 32–39. The back side of the housing has been broken away to reveal the internal parts of the latch 10. The initial unlatched position of the latch's components is illustrated in FIGS. 32–33. The hook beam 14 is adjacent to the right side 26 of the housing 12 opposite the shuttle 16 with the top flange 84 abutting the shuttle's flange 116, and detent boss 86 on the stem 88 of the hook beam snapped into the right side of the resilient finger 48 of the housing. FIGS. 34–35 illustrate the bottom surface 134 of keeper 20 pushing inward on the top portion 110 of the shuttle 16. As the shuttle 16 is pushed downward, the shuttle's skirt 120 pushes against the hook beam's bottom arm 98. The shuttle's top portion 110 is simultaneously moved below the top hook 80 of the hook beam 14. Because the hook beam's opposing bosses 100 are constrained within the housing's openings 40, the hook beam 14 rotates counterclockwise (in the view shown in FIG. 34) so that the detent boss 86 on the stem 88 of the hook beam 14 moves from the left to the right side (in the view shown in FIG. 35) of the resilient finger 48 of the housing 12. Simultaneously, the hook beam's top hook 80 engages the keeper's hook 132. Proper alignment of the top hook 80 of the hook beam 14 for engagement with the hook 132 of the keeper 20 is insured by the detent boss 86 which is constrained from moving back to its original position by the resilient finger 48 of the housing. At this point, the user will release the pressure on the moving member, allowing the spring 18 to push the shuttle 16 slightly upward. As the shuttle 16 pushes the keeper 20 slightly upward, the hook 132 of the keeper 20 pulls on the top hook 80 of the hook beam 14 which will in turn pull the hook beam 14 into a vertical position. Proper vertical alignment of the hook beam 14 is insured by the detent boss 86 on the stem 88 of the hook beam which is constrained from moving back to its original position by the resilient finger 48 of the housing. Continued upward motion of the shuttle 16 is prevented by the keeper's hook 132 which is held by the top hook 80 and blocks the shuttle 16 from returning to its original position. The latch 10 is now securely latched as illustrated in FIGS. 36–37.

The latch 10 is unlatched by pushing inward on the moving member, which again causes the bottom surface 134 of keeper 20 to push inward on the top portion 110 of shuttle 16. The overhang 112 of the top portion 110 of shuttle 16 pushes down on the top side 96 of the central projection 94 of hook beam 14. The downward push on the central projection 94 causes the bottom end of the hook beam 14 to move downward, the bottom end of the beam 14 now being located at the end of the opening 40 closest to the shuttle 16. This downward movement brings the corners 44 into interference with the notches 102. This interference with the notches 102 prevents translation of the bottom end of the hook beam 14 along the openings 40. As the hook beam 14 is pushed down by the overhang 112 of the shuttle 16, the bottom of the bottom arm 98 of the hook beam 14 contacts the ramp 52 of the housing 12 which creates a reaction force which rotates the top hook 80 and the stem 88 of the hook beam 14 away from the hook 132 of the keeper 20 as shown in FIG. 38. Simultaneously, the detent boss 86 at the top of the stem 88 of the hook beam 14 is snapped into to the left side of the resilient finger 48 as shown in the view of FIG. 39. As the hook 132 of the keeper 20 is released from the top hook 80 of the hook beam 14, the shuttle 16 is pushed forward by spring 18. The shuttle's flange 116 engages the hook beam's top flange 84, thereby moving the hook beam 14 back into its original position. Proper vertical alignment of the hook beam 14 is ensured by the detent boss 86 on the hook beam 14 which is constrained from moving back to its previous position by the resilient finger 48 of the housing 12. The unlatching process is now complete, and the latch 10 is ready to repeat the cycle beginning with the view shown in FIG. 32.

Figure 40:
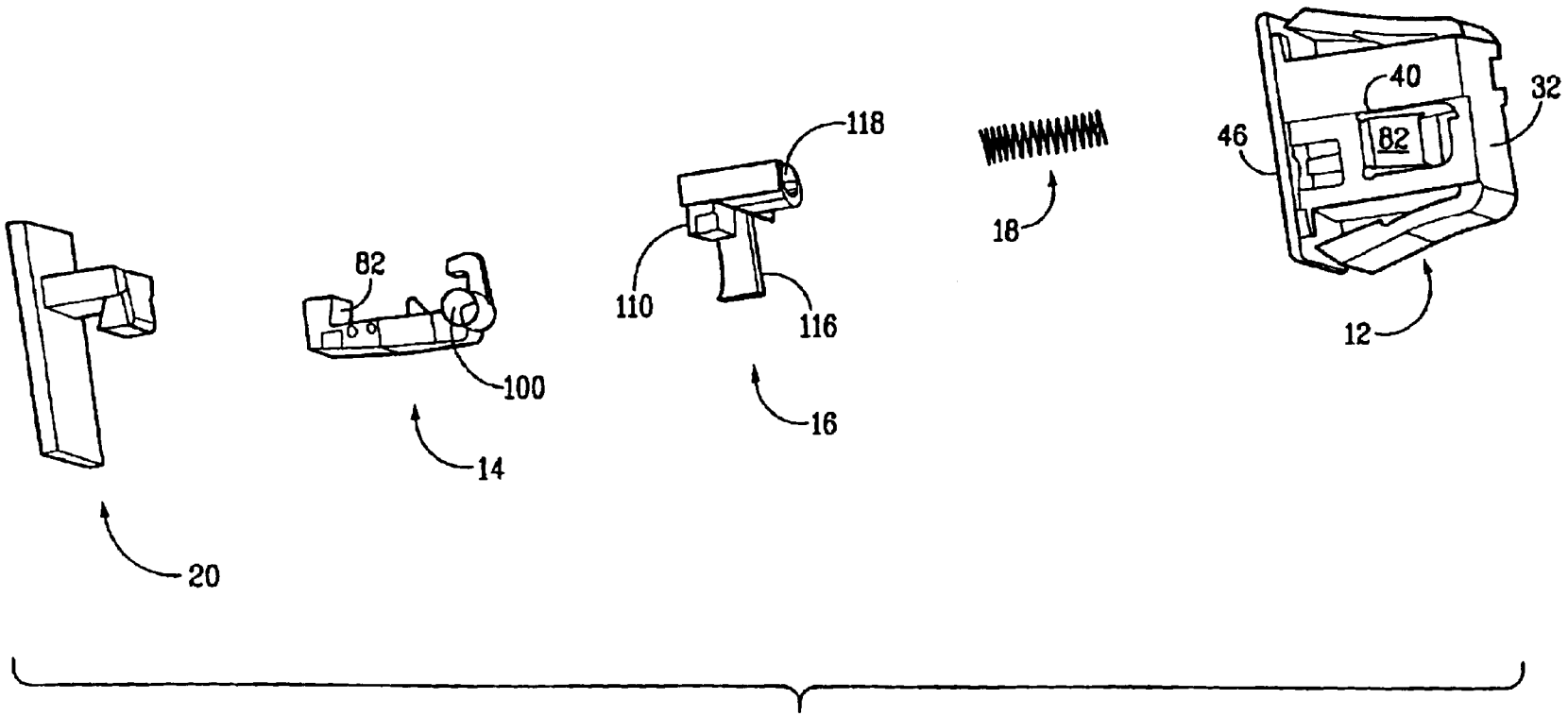
FIG. 40 is a front exploded perspective view of a latch assembly according to the present invention.

The assembly of the latch 10 is illustrated in FIG. 40. Spring 18 is inserted into the spring channel 118 of the shuttle 16, and the shuttle 16 is positioned adjacent to the hook beam 14 so that the flange 116 of the shuttle 16 abuts the bottom of the hook's top flange 84 and the top surfaces of the top hook 80 and the top portion 110 of the shuttle 16 are level with one another. The preassembled hook beam 14, shuttle 16, and spring 18 are then inserted through the top opening 34 of the housing 12. The spring 18 is now compressed between the shuttle 16 and the bottom 32 of the housing 12. The hook beam's bosses 100 snap into the openings 40 of the housing 12, and are engaged by the resilient inner snap legs 42. The shuttle's flange 116 abuts the hook beam's top flange 84, thereby securing the shuttle 16, hook beam 14, and spring 18 within the housing 12. In the unlatched, at rest position, the hook beam 14 is adjacent to the right side 26 of the housing 12, with the top hook 80 resting against the overhang 112 of the top portion 110 of the shuttle, and the top flange 84 abutting the shuttle's flange 116.

It is to be understood that the invention is not limited to the preferred embodiments described herein, but encompasses all embodiments within the scope of the following claims.

I claim:

1. A push-push latch for latching with a keeper, the keeper having a hook, said push-push latch comprising:

a housing defining a top opening and a front opening, said front opening having a resilient finger projecting therein;

a beam having a top hook, said top hook being dimensioned and configured to mate with the hook of the keeper, a stem, a detent boss which extends along said stem, a central projection projecting from said stem, and a bottom arm, wherein said stem detent boss contacts said resilient finger for movement thereof as said beam is moved and said stem detent boss passes said finger; and a shuttle having an arm, said shuttle being spring-biased toward said top opening.

2. The push-push latch according to claim 1, wherein said housing further comprises:

a pair of opposing front and back openings; and said beam further comprises a pair of bosses being dimensioned and configured to fit within said front and back openings of said housing.

3. The push-push latch according to claim 2 wherein said housing's front and back openings further comprise a bottom edge, a notch within said bottom edge, and a corner adjacent to said notch, and wherein said hook beam's bosses defines a notch, said notch being dimensioned and configured to correspond to be engageable by said corner within said front and back openings' bottom edges.

4. The push-push latch according to claim 3, wherein each of said housing's front and back openings further comprise; a snap leg extending downward and inward from one side of said front and back openings.

5. The push-push latch according to claim 4, wherein said housing further comprises:

a pair of snap legs extending outward and upward from said housing.

6. The push-push latch according to claim 5, wherein each of said snap 10 legs includes a ridged end.

7. The push-push latch according to claim 6, wherein said top hook has a top flange, and wherein said shuttle has a flange extending outward from one side of said shuttle, being dimensioned and configured to abut the top flange of said top hook.

8. The push-push latch according to claim 7, wherein said shuttle further comprises a spring channel.

9. The push-push latch according to claim 1, wherein said top hook has a top flange, and wherein said shuttle has a flange extending outward from one side of said shuttle, said shuttle flange being dimensioned and configured to abut the top flange of said top hook.

10. The push-push latch according to claim 1, wherein said housing further comprises:

a pair of snap legs extending outward and upward from said housing.

11. The push-push latch according to claim 10, wherein each of said snap legs includes a ridged end.

12. The push-push latch according to claim 1, wherein said shuttle further comprises a spring channel.

13. A push-push latch for latching with a keeper, the keeper having a hook, said push-push latch comprising:

a housing having an interior wall and a ramp wall portion of said interior wall of said housing, said ramp wall being defined by a flat planar surface;

a beam having a top hook, said top hook being dimensioned and configured to mate with the hook of the keeper, a stem, a projection extending from said stem, and a bottom arm, wherein said bottom arm engages said interior wall ramp wall portion to cause pivotal motion of said beam to disengage said top hook from the hook of the keeper; and a shuttle having an arm, said shuttle being spring-biased upward.

14. The push-push latch according to claim 13, wherein said housing further comprises:

a pair of opposing front and hack openings; and said beam further comprises a pair of bosses being dimensioned and configured to fit within said front and back openings of said housing.

15. The push-push latch according to claim 14 wherein said housing's front and back openings further comprise a bottom edge, a notch within said bottom edge, and a corner adjacent to said notch, and wherein said hook beam's bosses defines a notch, said notch being dimensioned and configured to be engageable with said corner within said front and back openings' bottom edges.

16. The push-push latch according to claim 15, wherein each of said housing's front and back openings further comprise:

a snap leg extending downward and inward from one side of said front and back openings.

17. The push-push latch according to claim 16, wherein said housing further comprises:

a pair of snap legs extending outward and upward from said housing.

18. The push-push latch according to claim 17, wherein each of said snap legs includes a ridged end.

19. The push-push latch according to claim 18, wherein said top hook has a top flange, and wherein said shuttle has a flange extending outward from one side of said shuttle, being dimensioned and configured to abut the top flange of said top hook.

20. The push-push latch according to claim 19, wherein said shuttle further comprises a spring channel.

21. The push-push latch according to claim 13, wherein said housing further comprises:

a pair of snap legs ending outward and upward from said housing.

22. The push-push latch according to claim 20, wherein each of said snap legs includes a ridged end.

23. The push-push latch according to claim 13, wherein said top hook has a top flange, and wherein said shuttle has a flange extending outward from one side of said shuttle, being dimensioned and configured to abut the top flange of said top hook.

24. The push-push latch according to claim 13, wherein said shuttle further comprises a spring channel.

25. A push-push latch for latching with a keeper, the keeper having a hook, said push-push latch comprising:

a housing having a bottom and a ramp formed therein, wherein the ramp is defined by a flat planar surface;

a beam having a top hook, said top hook being dimensioned and configured to mate with the hook of the keeper, a stem, a projection extending from said stem, said projection having a flat top horizontal surface and a bottom ramped surface, and a bottom arm; and a shuttle, being movable downward toward said housing bottom and upward away therefrom having an arm, said shuttle being spring-biased upward, wherein said shuttle under movement is engageable with said beam projection to thereby move said beam toward said housing bottom when said shuttle is moved downward, and to thereby move said beam to move upward and away from said hook of said keeper when shuttle is moved upward wherein said bottom arm engages said ramp to cause a pivotal motion of said beam thereby causing said beam to disengage said top hook from the hook of the keeper.

26. The push-push latch according to claim 25, wherein said housing further comprises:

a pair of opposing front and back openings; and said beam further comprises a pair of bosses being dimensioned and configured to fit within said front and back openings of said housing; and wherein said beam flat top-sided projection is approximately trapezoidal in configuration.

27. The push-push latch according to claim 26 wherein said housing's front and back openings further comprise a bottom edge, a notch within said bottom edge, and a corner adjacent to said notch, and wherein said beam's bosses defines a notch, said notch being dimensioned and configured to be engageable with said corner within said front and back openings' bottom edges.

28. The push-push latch according to claim 27, wherein each of said housing's front and back openings further comprise:

a snap leg extending downward and inward from one side of said front and back openings.

29. The push-push latch according to claim 28, wherein said housing further comprises:

a pair of snap legs extending outward and upward from said housing.

30. The push-push latch according to claim 29, wherein each of said snap legs includes a ridged end.

31. The push-push latch according to claim 30, wherein said top hook has a top flange, and wherein said shuttle has a flange extending outward from one side of said shuttle, being dimensioned and configured to abut the top flange of said top hook.

32. The push-push latch according to claim 31, wherein said shuttle further comprises a spring channel.

33. The push-push latch according to claim 25, wherein said housing further comprises:

a pair of snap legs extending outward and upward from said housing.

34. The push-push latch according to claim 33, wherein each of said snap legs includes a ridged end.

35. The push-push latch according to claim 25, wherein said top hook has a top flange, and wherein said shuttle has a flange extending outward from one side of said shuttle, being dimensioned and configured to abut the top flange of said top hook.

36. The push-push latch according to claim 25, wherein said shuttle further comprises a spring channel.

37. The push-push latch according to claim 8, wherein said housing further comprises a ramp wherein said bottom arm engages said ramp to cause pivotal motion of said beam to disengage said top hook from the hook of the keeper, and wherein said central projection projecting from said stem has a flat top side.

* * * * *